US008104761B2

(12) United States Patent
Seto et al.

(10) Patent No.: US 8,104,761 B2
(45) Date of Patent: Jan. 31, 2012

(54) IMAGE FORMING APPARATUS, COMPUTER READABLE MEDIUM, PAPER FEED CONTROL METHOD, AND IMAGE FORMING SYSTEM

(75) Inventors: Tsuyoshi Seto, Kanagawa (JP); Yuichi Hoshino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 319 days.

(21) Appl. No.: 12/555,333

(22) Filed: Sep. 8, 2009

(65) Prior Publication Data

US 2010/0225046 A1 Sep. 9, 2010

(30) Foreign Application Priority Data

Mar. 5, 2009 (JP) ..... 2009-052110

(51) Int. Cl.
*B65H 5/00* (2006.01)

(52) U.S. Cl. ..... 271/9.01; 399/391

(58) Field of Classification Search ..... 271/9.01; 399/391

See application file for complete search history.

(56) References Cited

U.S. PATENT DOCUMENTS

| | | | | |
|---|---|---|---|---|
| 6,204,872 | B1 * | 3/2001 | Hashimoto et al. | 347/153 |
| 6,925,283 | B1 * | 8/2005 | Mandel et al. | 399/388 |
| 6,959,165 | B2 * | 10/2005 | Mandel et al. | 399/391 |
| 7,171,153 | B2 * | 1/2007 | Eguchi | 399/391 |
| 7,237,772 | B2 * | 7/2007 | Kamamura | 271/9.01 |
| 7,389,084 | B2 * | 6/2008 | Watanabe et al. | 399/391 |
| 2010/0327511 | A1 * | 12/2010 | Yogev et al. | 271/3.15 |

FOREIGN PATENT DOCUMENTS

JP 2006-091395 A 4/2006

* cited by examiner

*Primary Examiner* — Kaitlin Joerger
(74) *Attorney, Agent, or Firm* — Sughrue Mion, PLLC

(57) ABSTRACT

An image forming apparatus includes an image forming apparatus body provided with an image formation unit and plural paper feeding apparatuses. Paper conveyance paths of the plural paper feeding apparatuses are daisy-chained with respect to the image forming apparatus body. An output unit outputs an instruction signal which instructs a specified paper feeding apparatus to start feeding a paper. A paper feed unit feeds the paper upon receipt of the instruction signal. A recognition unit recognizes a delay time until an analysis that the instruction signal is a paper feed instruction. A correction unit corrects an output timing of the instruction signal based on the delay time.

15 Claims, 8 Drawing Sheets

IMAGE FORMING APPARATUS, COMPUTER READABLE MEDIUM, PAPER FEED CONTROL METHOD, AND IMAGE FORMING SYSTEM

CROSS-REFERENCE TO RELATED APPLICATIONS

This application is based on and claims priority under 35 USC 119 from Japanese Patent Application No. 2009-052110 filed Mar. 5, 2009.

BACKGROUND

1. Technical Field

The invention relates to an image forming apparatus, a computer readable medium, a paper feed control method, and an image forming system.

2. Related Art

A technique in which controllers of each of an image forming apparatus and a peripheral device (a large capacity paper tray) communicate with each other via a serial communication line and a hotline is provided. Communications are not easily influenced by noise, whereby an accuracy of conveying a paper from a paper tray to the image forming apparatus is improved.

SUMMARY

According to a first aspect of the invention, there is provided an image forming apparatus including: an image forming apparatus body provided with an image formation unit which forms an image on a paper based on image information; a plurality of paper feeding apparatuses, each of the plurality of paper feeding apparatuses accommodating the paper therein and feeding the paper to the image forming apparatus body, paper conveyance paths of the plurality of paper feeding apparatus being daisy-chained with respect to the image forming apparatus body; an output unit that, using a signal transmission path, outputs an instruction signal which instructs a specified one of the paper feeding apparatuses to start feeding the paper when the image is formed by the image formation unit; paper feed units disposed in the plurality of paper feeding apparatuses and that feed the paper upon receipt of the instruction signal from the output unit; a recognition unit disposed in the image forming apparatus body and that recognizes a delay time of each of the plurality of paper feeding apparatuses the delay time being from after the instruction signal is received until it is determined by analysis that the instruction signal is a paper feed instruction; and a correction unit that corrects an output timing of the instruction signal from the output unit based on the delay time of each of the paper feeding apparatuses recognized by the recognition unit.

BRIEF DESCRIPTION OF THE DRAWINGS

Exemplary embodiments of the present invention will be described in detail based on the following figures, wherein.

DETAILED DESCRIPTION

A detailed description will be given below of exemplary embodiments according to the present invention with reference to the attached drawings. Explanation will be made on an image forming apparatus for forming an image by electrophotography, to which the invention is applied.

(Configuration of Image Forming System)

Figure 1:
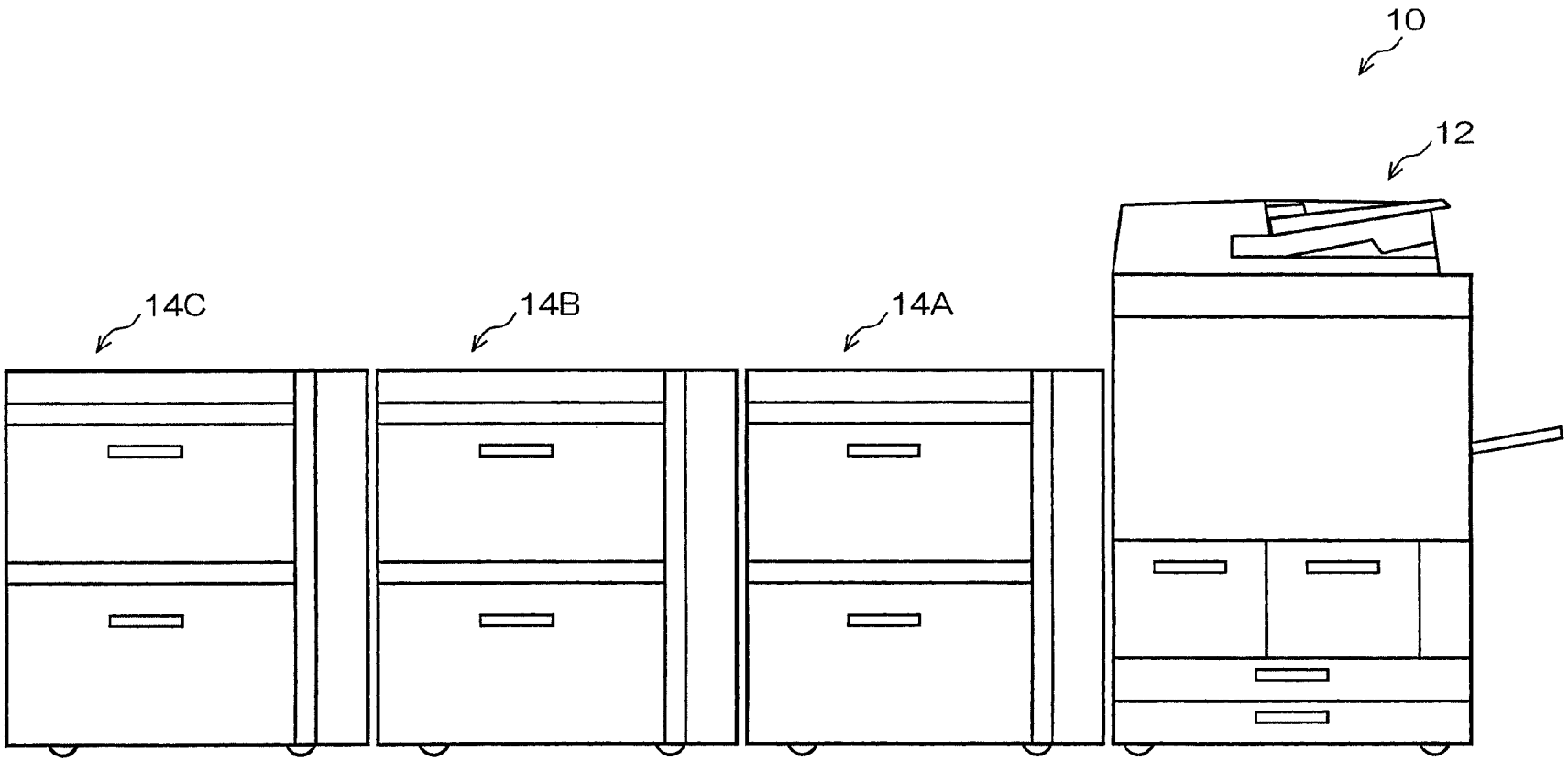
FIG. 1 is a general view showing the configuration of an image forming system in the present exemplary embodiment.

FIG. 1 is a general view showing the configuration of an image forming system 10 including an image forming apparatus 12 in the present exemplary embodiment. The image forming system 10 in the exemplary embodiment is constituted of the image forming apparatus 12 and external paper feeding apparatuses 14A, 14B, and 14C (generically called "a paper feeding apparatus 14") for feeding a recording paper P. The image forming apparatus 12 and the paper feeding apparatus 14 are connected to each other via a connector, not shown. In the exemplary embodiment, the image forming system 10 is provided with the paper feeding apparatuses 14A, 14B, and 14C, however members to be provided are not limited to these.

The image forming apparatus 12 is adapted to form an image on an intermediate transfer member based on image data, transfer the image formed on the intermediate transfer member onto a paper, and form (i.e., print) an image on the paper. The paper feeding apparatus 14 is an external type that feeds the paper to the image forming apparatus 12. A post-processing device may be connected to the image forming apparatus 12, thereby post-processing (e.g., stapling, punching, folding (into two or three leaves), sticking, trimming, or the like) the paper having the image formed thereon in the image forming apparatus 12.

(Schematic Configuration of Image Forming System)

Figure 2:
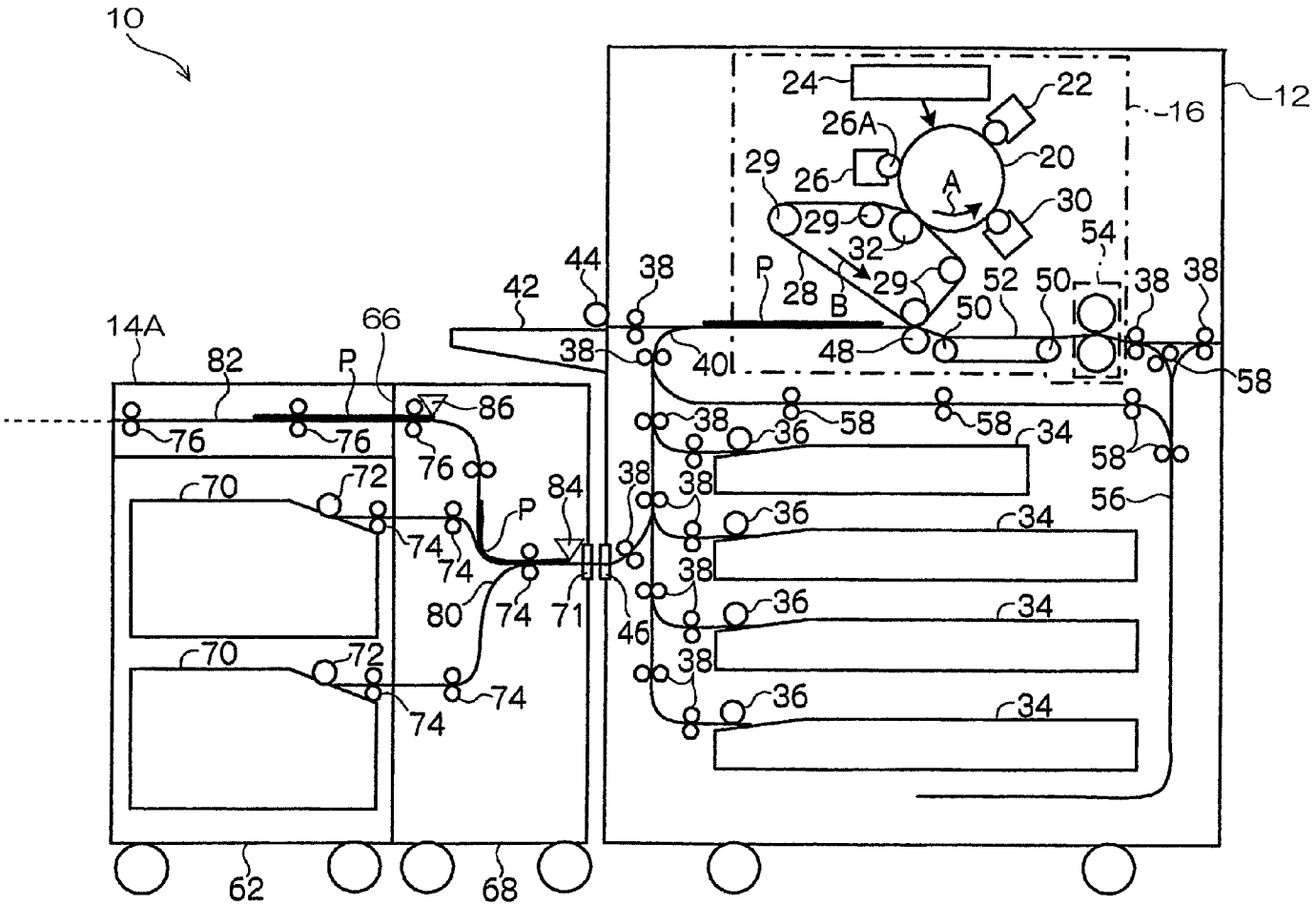
FIG. 2 is a schematic view showing the configuration of the image forming system in the present exemplary embodiment.

As shown in FIG. 2, the paper feeding apparatus 14A is connected to the image forming apparatus 12 in the image forming system 10 in the exemplary embodiment. The other paper feeding apparatuses 14 will be omitted below.

The image forming apparatus 12 includes an image forming engine 16 that carries out image forming processing on the recording paper P based on the image data. The image forming engine 16 corresponds to an image formation unit.

The image forming engine 16 is provided with a photoreceptor drum 20. The photoreceptor drum 20 is rotated at a predetermined speed in a direction indicated by an arrow A in FIG. 2 by a driving force of a driving unit such as a motor, not shown. A charger 22 that electrically charges an peripheral surface of the photoreceptor drum 20 is disposed at the upper right portion of the photoreceptor drum 20 in FIG. 2.

An optical beam scanner 24 is arranged at the upper left side of the charger 22 in FIG. 2. The optical beam scanner 24 scans the peripheral surface of the photoreceptor drum 20 electrically charged by the charger 22 with a light beam in parallel to an axis of the photoreceptor drum 20 based on image data. In this manner, an electrostatic latent image is formed on the peripheral surface of the photoreceptor drum 20. For the sake of simple explanation, only one set of the photoreceptor drum 20 and the like is shown in FIG. 2.

A developing device 26 is disposed at the left side of the photoreceptor drum 20 in FIG. 2. The developing device 26 includes a developing roller 26A, and contains a toner therein. The developing roller 26A allows the toner to adhere onto the electrostatic latent image formed on the periphery of the photoreceptor drum 20, and then, develops the image.

Under the photoreceptor drum 20 in FIG. 2, an endless intermediate transfer belt 28 is arranged. The intermediate transfer belt 28 is wound around plural rollers 29, and further, its periphery is brought into contact with the peripheral surface of the photoreceptor drum 20. Each of the rollers 29 rotates the intermediate transfer belt 28 at the same rotational speed as that of the photoreceptor drum 20 in a direction indicated by an arrow B in FIG. 2 by a driving force transmitted from a motor, not shown.

A transfer device 32 is disposed at a contact position between the photoreceptor drum 20 and the intermediate transfer belt 28 and at an opposite side of the photoreceptor drum 20 such that the transfer device 32 holds the intermediate transfer belt 28 with the photoreceptor drum 20. The toner image developed on the photoreceptor drum 20 is transferred onto the intermediate transfer belt 28 by the transfer device 32 at a transfer position in which the transfer device 32 contacts with the intermediate transfer belt 28 according to the rotation of the photoreceptor drum 20.

A charge removal and cleaner device 30, which has functions of electrically discharging the periphery of the photoreceptor drum 20 and removing an unnecessary toner remaining on the periphery, is arranged at a downstream side of the transfer position on the periphery of the photoreceptor drum 20 in a rotational direction. After transferring the toner onto the intermediate transfer belt 28, a region which has carried the transferred toner image, on the periphery of the photoreceptor drum 20 is cleaned by the charge removal and cleaner device 30.

Plural paper trays 34 (four in the exemplary embodiment) are installed under the image forming engine 16 in the image forming apparatus 12. Each of the paper trays 34 may change a size of a recording paper P which is to be accommodated therein by adjusting a position of an inside partition or the like. The plural recording papers P are accommodated inside of each of the paper trays 34. Plural mechanical switches, not shown, for detecting the size of the accommodated recording paper P are disposed in each of the paper trays 34. When each of the mechanical switches is brought into contact with the accommodated recording paper P, the combination of turning-on and off is changed according to the size of the recording paper P. The size of the accommodated recording paper P is detected based on a combination of turning-on and off of the mechanical switches.

A taking-out roller 36 is disposed at the diagonally upward to the left of each of the paper trays 34 in FIG. 2. Plural roller pairs 38 are arranged in sequence at a downstream side in the taking-out direction of the recording paper P of the taking-out roller 36 in each of the paper trays 34. The uppermost recording paper P accommodated on each of the paper trays 34 is taken out from the paper tray 34 according to the rotation of the taking-out roller 36, and then, the paper is conveyed to the intermediate transfer belt 28 in synchronism with the transferred toner image via a conveyance path 40 by the plural roller pairs 38.

At the center left portion of the image forming apparatus 12 in FIG. 2, there is provided a manual tray 42, on which the recoding paper P is manually placed. A taking-out roller 44 is disposed at the diagonally upward to the right of the manual tray 42 in FIG. 2. The recoding paper P placed on the manual tray 42 is guided onto the conveyance path 40 by the taking-out roller 44 and the roller pairs 38, and then, is conveyed to the intermediate transfer belt 28 through the conveyance path 40.

At the lower portion of the image forming apparatus 12 in FIG. 2, there is provided a paper inlet 46, through which the recoding paper P is fed from the paper feeding apparatus 14A. The recoding paper P fed through the paper inlet 46 is guided at a portion in which a recoding paper P conveyed from a paper tray 34 of the second stage conveys on the conveyance path 40 by the roller pairs 38, and then, the paper P is conveyed to the intermediate transfer belt 28 through the conveyance path 40.

A transfer device 48 is disposed at an opposite side of the lowermost roller 29 sandwitching the intermediate transfer belt 28. The recoding paper P conveyed to the intermediate transfer belt 28 through the conveyance path 40 is fed between the intermediate transfer belt 28 and the transfer device 48, and then, the toner image on the intermediate transfer belt 28 is transferred on the recording paper P by the transfer device 48. An endless conveyor belt 52 wound around two rollers 50 is disposed at a downstream side of the transfer device 48 in the conveyance direction of the recoding paper P. The recoding paper P having the toner image transferred thereonto is conveyed to a fixing device 54 via the conveyor belt 52, followed by melting and fixing by the fixing device 54, and then, the recording paper P is ejected outside of the image forming apparatus 12 onto a ejecting tray, not shown.

The image forming apparatus 12 is provided with a double-sided recording reverse path 56. The reverse path 56 includes plural roller pairs 58. The recoding paper P having the image recorded on either side thereof is reversed on the reverse path 56, and then, is conveyed to the intermediate transfer belt 28. Images may be recorded on both sides of the recoding paper P.

A connecting unit 68 has a paper outlet 71 at a position facing to the paper inlet 46 provided in the image forming apparatus 12. The paper feeding apparatus 14A is installed in such a manner that the paper outlet 71 faces the paper inlet 46.

A paper feed unit 62 includes plural paper trays 70 (two in the exemplary embodiment). Each of the paper trays 70 also may contain the recording papers P of various sizes therein by adjusting the position of an inside partition or the like. The plural recording papers P are accommodated inside of each of the paper trays 70. Each of the paper trays 70 includes plural mechanical switches, not shown, for detecting the size of the accommodated recording paper P, like the above-described paper trays 34.

A taking-out roller 72 is disposed at a diagonally upward to the right of each of the paper trays 70 in the paper feed unit 62 in FIG. 2. Plural roller pairs 74 are arranged in sequence from a downstream side in the recording paper P taking-out direction of the taking-out roller 72 in the paper feed unit 62. The recording paper P is taken out from the paper tray 70 according to the rotation of the taking-out roller 72, and then, is conveyed to the paper outlet 71 via a conveyance path 80 provided in the connecting unit 68 by the plural roller pairs 74.

The recording paper P conveyed to the paper outlet 71 is fed to the image forming apparatus 12 through the paper inlet 46, and then, the recording paper P is conveyed to the intermediate transfer belt 28 via the conveyor path 40 by the roller pairs 38.

In the paper feeding apparatus 14A, a first paper detection sensor 84 is disposed on the conveyor path 80 and at an upstream side of the paper outlet 71 in the conveyance direction. The first paper detection sensor 84 detects whether or not the recording paper P exists at a position at which the sensor 84 faces the recording paper P, and outputs a signal indicating the existence of the recording paper P.

The paper feeding apparatuses 14B and 14C, not shown, also have a similar configuration. Recording papers P accommodated in the paper feeding apparatuses 14B and 14C are taken from paper trays 70 according to rotation of taking-out rollers 72, and then, are conveyed to a joining unit 66 in the paper feeding apparatus 14A. In the joining unit 66, the recording paper P reaches at a confluence portion between a conveyor path 82 and the conveyor path 80 inside of the connecting unit 68 by plural roller pairs 76 and the plural roller pairs 74, and then, the recording paper P is conveyed to the paper outlet 71 through the conveyor path 80. A second paper detection sensor 86 is disposed at an upstream side of the confluence portion between the conveyor path 82 and the conveyor path 80 in the conveyance direction, and thus the sensor 86 detects whether or not the recording paper P exists at a position at which the sensor 86 faces the recording paper P.

(Control System of Image Forming System 10)

Figure 3:
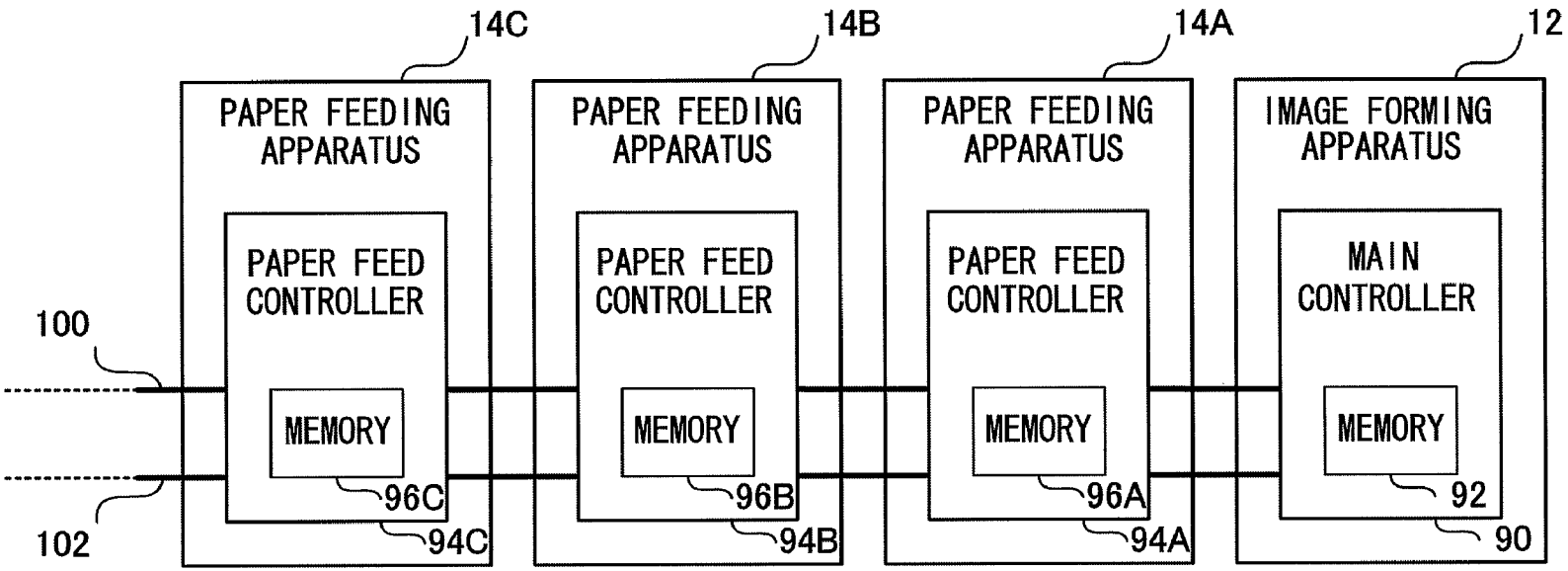
FIG. 3 is a block diagram illustrating the configuration of hardware in the image forming system in the exemplary embodiment.

As illustrated in FIG. 3, the image forming apparatus 12 and the plural paper feeding apparatuses 14 are daisy-chained in the image forming system 10 in the exemplary embodiment.

The image forming apparatus 12 manages and controls all the processing, and includes a main controller 90 and a memory 92. The paper feeding apparatus 14 includes a paper feed controller 94 (94A to 94C) for controlling the entire apparatus 14 and a memory 96 (96A to 96C). The main controller 90 corresponds to an output unit, a recognition unit, and a correction unit.

The image forming apparatus 12 (i.e., the main controller 90) and the paper feeding apparatuses 14 (i.e., the paper feed controllers 94) are connected to each other via an interactively receivable serial communication line 100 and a hot line 102. The hot line 102 is adapted to carry a direct electric signal which is unidirectionally output from the main controller 90 to the paper feed controller 94. The electric signal is off in a normal state, and the electric signal is turned on when the paper is started to be fed to the paper tray 70 in the paper feeding apparatus 14. In other words, the signal triggers feeding in the paper feeding apparatus 14. The paper feed controller 94 corresponds to a paper feed unit.

The paper feed controller 94 performs detection filtering (i.e., periodic software filtering) to avoid an influence by noise in detecting the signal on the hot line. Therefore, the filtering induces a delay in signal detection.

Figures 4A, 4B, 4C:
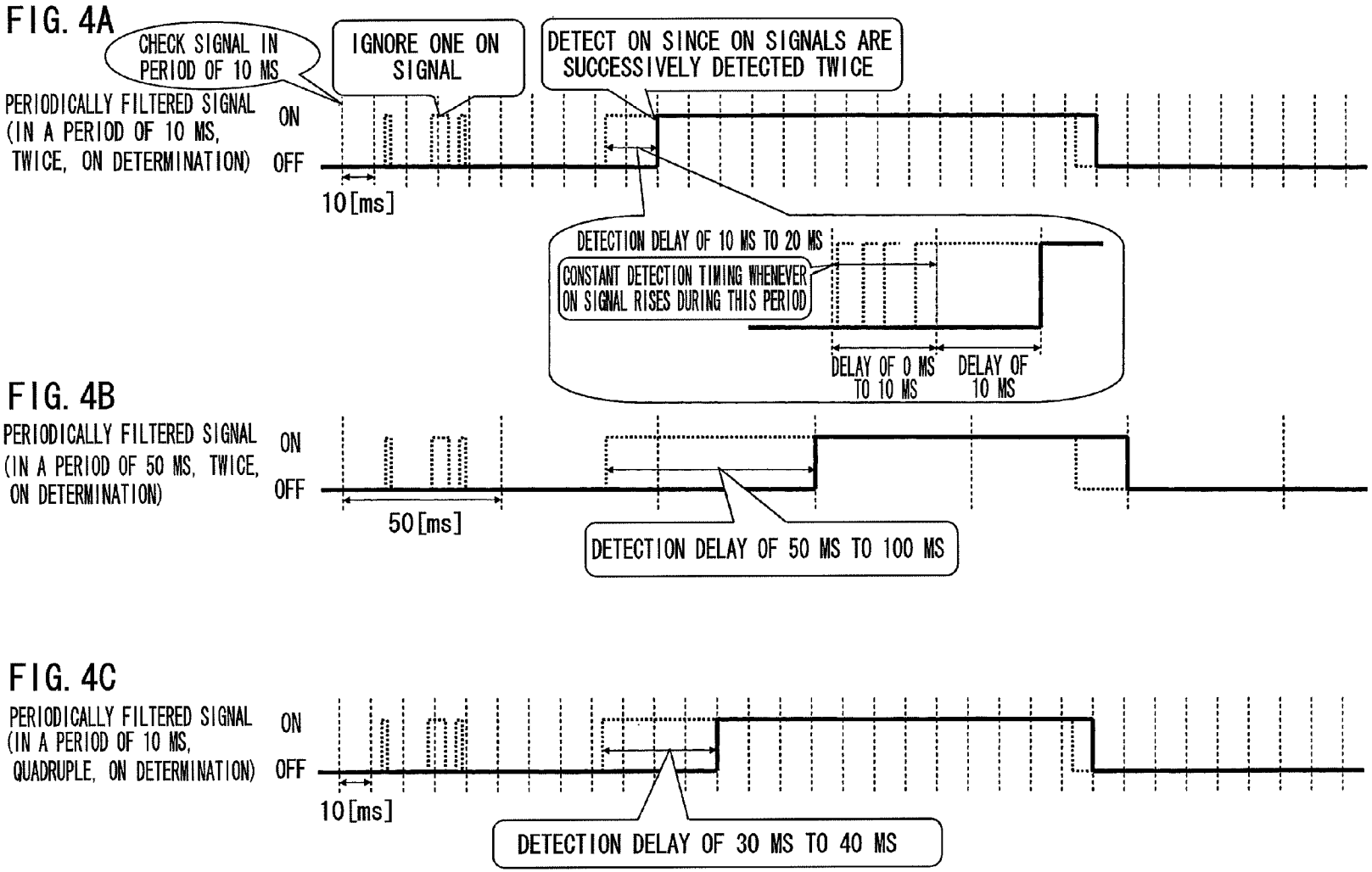
FIGS. 4A to 4C each are charts schematically illustrating flows of noise detection filtering.

For example, as illustrated in FIG. 4A, an ON instruction (i.e., an instruction to feed a paper) is determined to have been sent when an ON signal via the hot line 102 is successively detected twice at periods 10 ms apart. Specifically, filtering is performed at periods 10 ms apart (in 10 ms cycles), whereby if an ON signal is not detected successively, that is, if an ON signal is detected only once, the signal is determined to be noise. If an ON signal is successively detected twice, an ON instruction is determined to have been sent. Therefore, if an ON signal begins before the period at which the first detection is made, since the detection timing is constant, a delay of from 10 ms to 20 ms until the second detection is made arises.

FIG. 4B illustrates that ON is determined when the ON signal on the hot line 102 is successively detected twice at periods 50 ms apart. In this case, a delay in signal detection of 50 ms to 100 ms occurs.

FIG. 4C illustrates that ON is determined when the ON signal on the hot line 102 is successively detected quadruple at periods 10 ms apart. In this case, a delay in signal detection of 30 ms to 40 ms occurs.

Figures 5A, 5B:
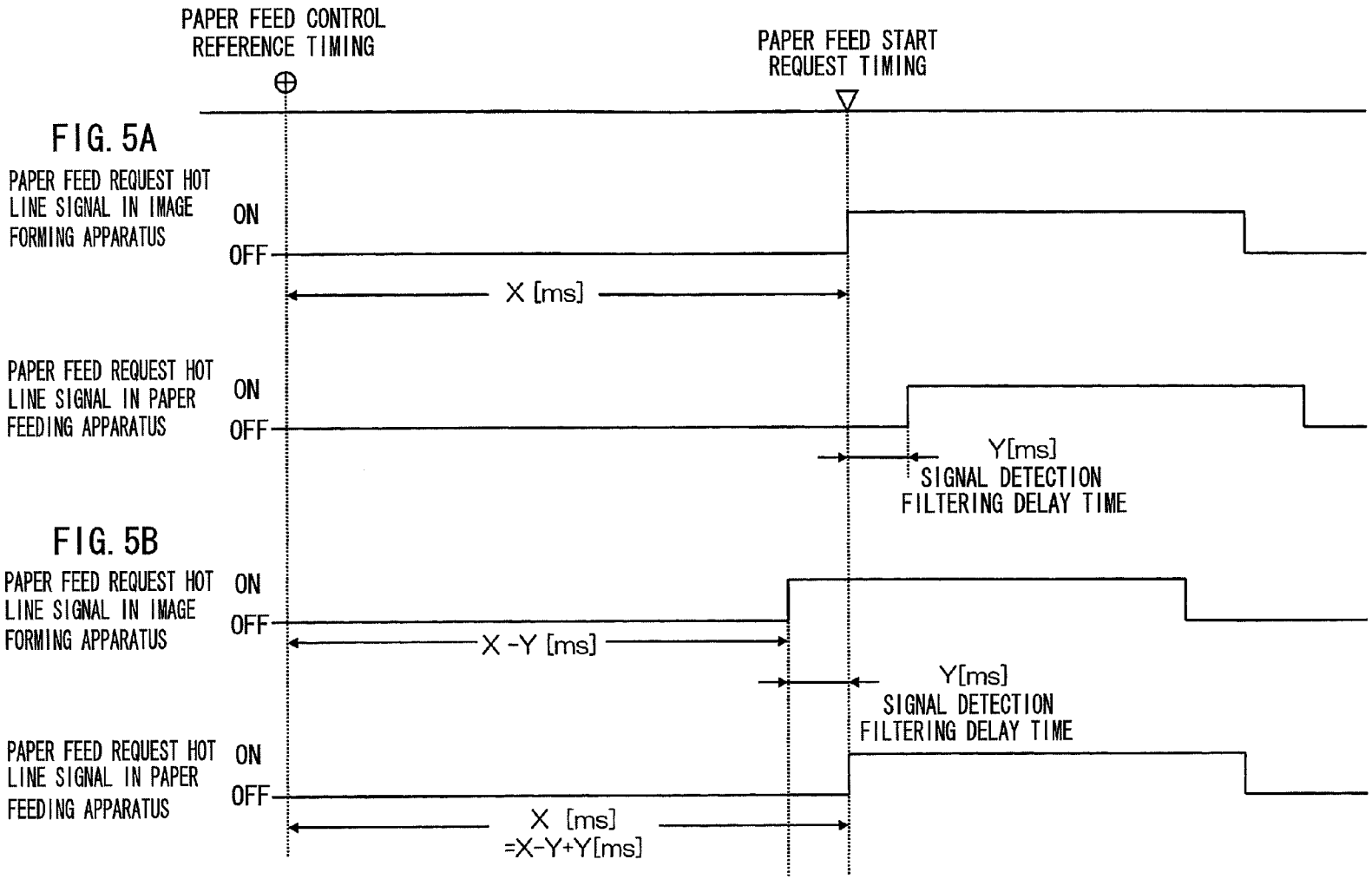
FIG. 5A is a timing chart illustrating transmission and reception of a hot line signal, to which the present exemplary embodiment is not applied.
FIG. 5B is a timing chart illustrating transmission and reception of a hot line signal in the exemplary embodiment.

As illustrated in FIG. 5A, even if the main controller 90 outputs a paper feed start request hot line signal (i.e., an ON signal) as an instruction signal to the paper feed controller 94 at a predetermined paper feed start request timing (X ms), which is determined in design, from a paper feed control reference timing of an upstream paper feeding apparatus, a delay in signal detection (a signal detection filtering delay time=Y ms) occurs at the paper feed controller 94.

When the plural paper feeding apparatuses 14 are daisy-chained to the image forming apparatus 12, the delays in signal detection due to the filtering are accumulated in a paper feeding apparatus 14 which is disposed at more downstream side.

In the exemplary embodiment, the main controller 90 acquired in advance a delay time of each of the paper feed controllers 94 via the serial communication line 100. In this manner, the main controller 90 outputs the paper feed start request hot line signal earlier by the delay time (i.e., X−Y ms), and thus, the paper feed controller 94 detects the signal at the predetermined paper feed start request timing (i.e., X ms) (see FIG. 5B).

Figure 6A:
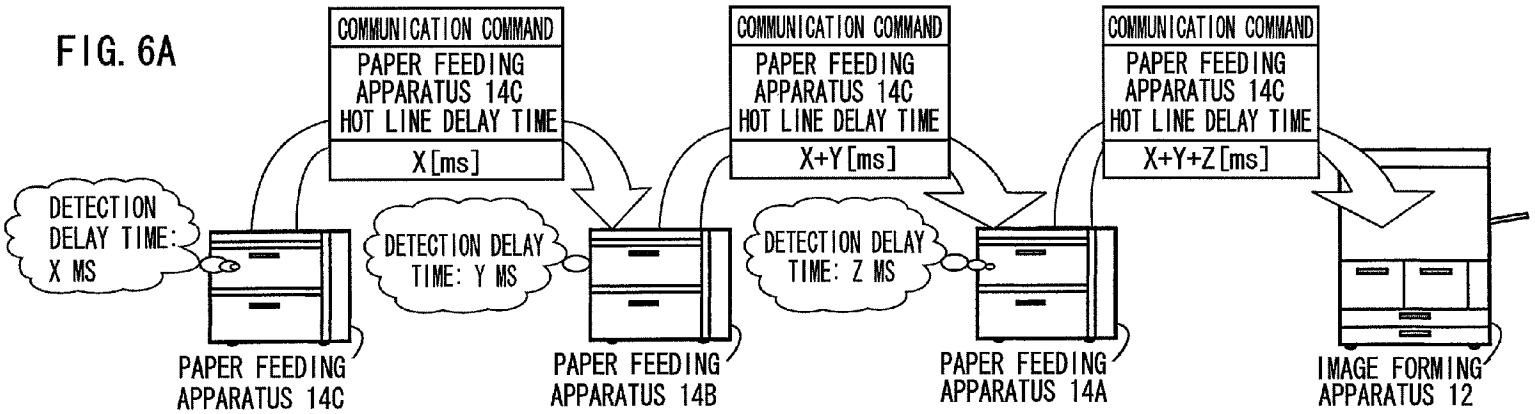
FIGS. 6A and 6B are diagrams schematically illustrating a flow of transmission of a delay time of a paper feeding apparatus.

More specifically, as illustrated in FIG. 6A, upon receipt of a notification command of the delay time of the paper feeding apparatus 14C from the main controller 90 (a use signal which indicates that the main controller 90 intends to use the paper feeding apparatus 14C), the paper feed controller 94C acquires its own delay time (X ms) from the memory 96C. The paper feed controller 94C writes the delay time in a communication command, and then transmits the command, as a signal in response to the use signal, to the paper feed controller 94B which is adjacent to the controller 94C at the upstream side thereof.

The paper feed controller 94B acquires its own delay time (Y ms) from the memory 96B upon receipt of the communication command. Thereafter, the paper feed controller 94B adds its own delay time to the delay time written in the communication command (X+Y ms). The paper feed controller 94B replaces the delay time in the communication command with the added delay time, and then, transmits the replaced delay time to the paper feed controller 94A (i.e., the paper feeding apparatus 14A) which is adjacent to the controller 94B at the upstream side.

In a similar manner, the paper feed controller 94A adds its own delay time (Z ms) acquired from the memory 96A to the delay time of the received communication command (X+Y+Z ms).

The main controller 90 acquires the communication command, and thus, stores the delay time (X+Y+Z ms) of the paper feed controller 94C (i.e., the paper feeding apparatus 14C) in the memory 92. Accordingly, the delay times of the paper feed controllers 94 are acquired. Alternatively, the delay times of the paper trays 70 in the paper feeding apparatuses 14 may be stored in the memory 92.

In the exemplary embodiment, the delay times of the paper feed controllers 94 (or the paper trays 70) are acquired, it is not limited to this. For example, delay times of the paper feed controllers 94 may be acquired by receiving a single communication command which has delay times of the paper feed controllers 94 written therein.

Figure 6B:
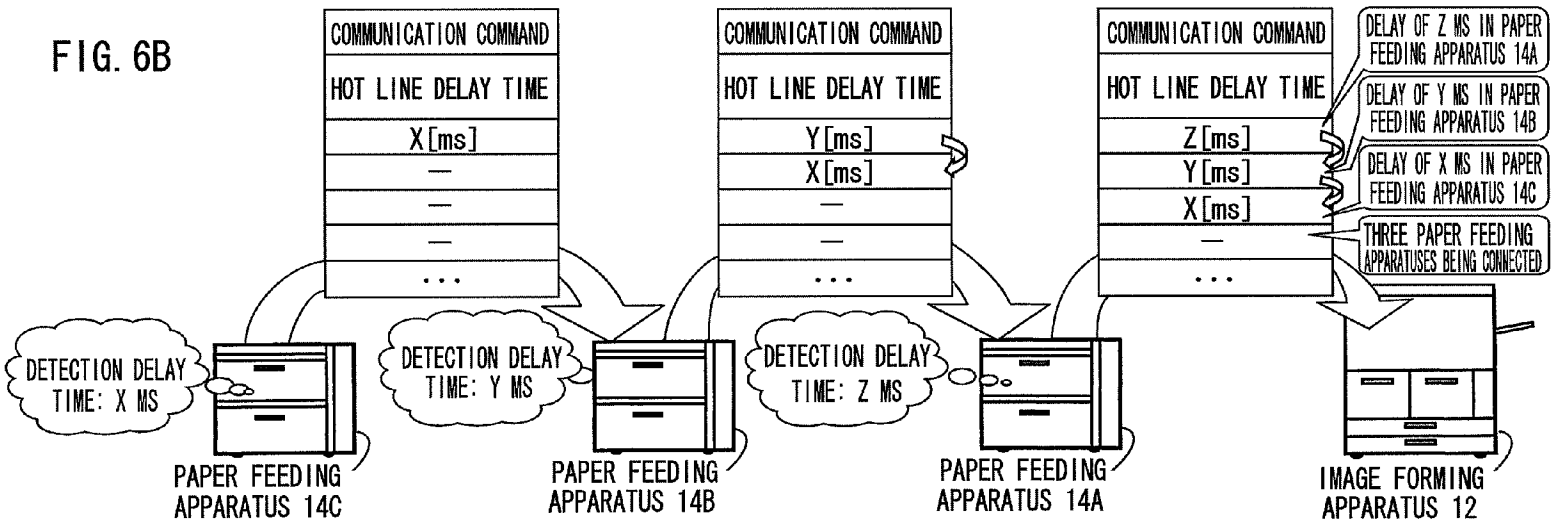

More specifically, as illustrated in FIG. 6B, the main controller 90 transmits a notification command of a delay time to the paper feed controller 94C which is disposed at the most downstream side. The paper feed controller 94C transmits a communication command which has its own delay time (X ms) written at the top thereof to the paper feed controller 94B which is adjacent to the controller 94C at the upstream side based on the command from the main controller 90.

The paper feed controller 94B shifts down the delay time of the paper feed controller 94C written at the top of the communication command, and then, writes its own delay time (Y ms) in the paper feed controller 94B at the top of the communication command. Thereafter, the paper feed controller 94B transmits the communication command to the paper feed controller 94A.

Likewise, the paper feed controller 94A shifts down the delay time written in the communication command, and then, writes its own delay time (Z ms) at the top of the communication command, so as to transmit it to the main controller 90.

The main controller 90 determines that the delay time (Z ms) written at the top of the communication command is a delay time of the paper feeding apparatus 14A which is directly connected to the image forming apparatus 12. Similarly, the main controller 90 determines that the delay time (Y ms) written under the delay time (Z ms) is a delay time of the paper feeding apparatus 14B which is connected to the paper feeding apparatus 14A, and further, that the delay time (X ms) written under the delay time (Y ms) is a delay time of the paper feeding apparatus 14C which is connected to the paper feeding apparatus 14B.

In other words, the main controller 90 finds that a delay time which is written more upward on the communication command corresponds to a paper feeding apparatus 14 which is disposed at more upstream side. Additionally, the main controller 90 finds from the number of delay times written in the communication command that the three paper feeding apparatuses 14 are connected to the image forming apparatus 12.

A delay time may be written without shifting down a preceding delay time, and may be written under a preceding delay time in the communication command.

Explanation will be made below on the function produced by the exemplary embodiment.

Figure 7:
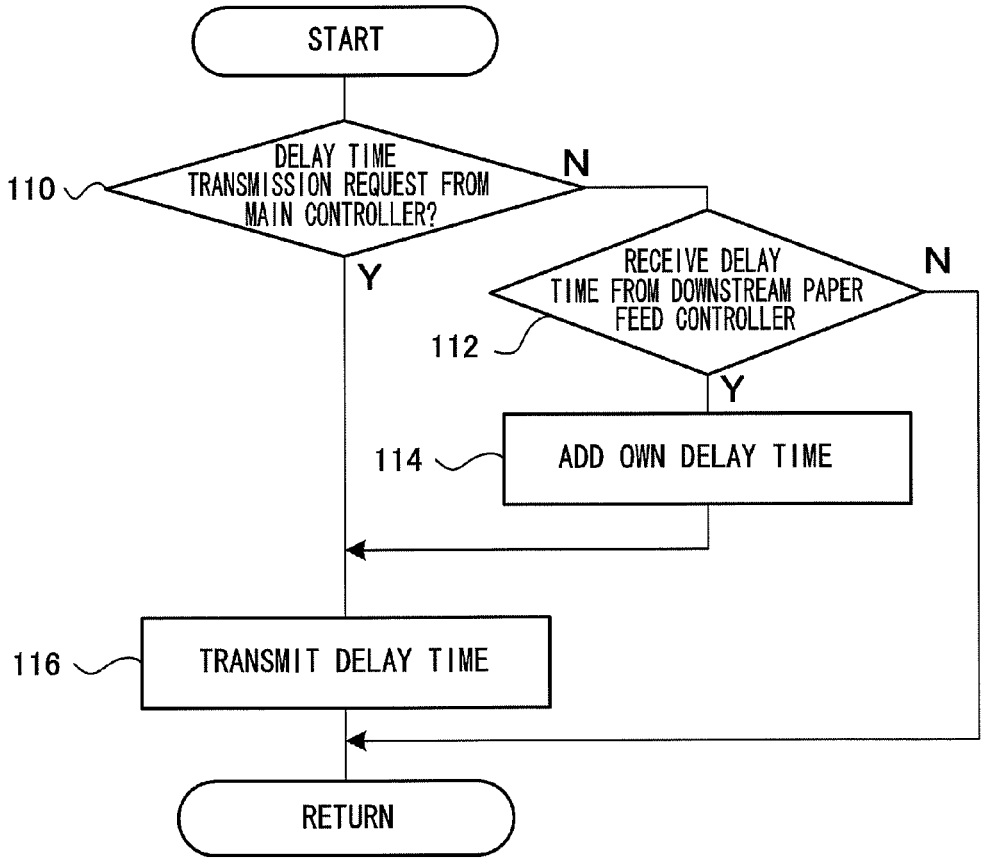
FIG. 7 is a flowchart illustrating a delay time transmission routine in a paper feed controller in the exemplary embodiment.

FIG. 7 is a flowchart illustrating a delay time transmission routine in a paper feed controller 94.

In step 110, it is determined whether or not the main controller 90 outputs the transmission request for its own delay time. If the result is affirmative, the routine jumps to step 116. To the contrary, if the result is negative, the routine proceeds to step 112.

In step 112, it is determined whether or not another paper feed controller 94 which is adjacent to the paper feed controller 94 at the downstream side outputs the communication command which has the delay time written therein. If the result is negative, the routine ends. To the contrary, if the result is affirmative, the routine proceeds to step 114.

In step 114, its own delay time is added to the delay time written in the received communication command. For example, the delay time which is obtained by adding its own delay time to the previously written delay time is written as a new delay time. Alternatively, its own delay time is added to the delay time previously written in the communication command to obtain a new delay time. Thereafter, the routine proceeds to next step 116.

In step 116, the communication command which has its own delay time (or, the added delay time) written therein is transmitted to another paper feeding apparatus 14 which is adjacent to the paper feeding apparatus at the upstream side or the image forming apparatus 12. In this manner, the routine ends.

Figure 8:
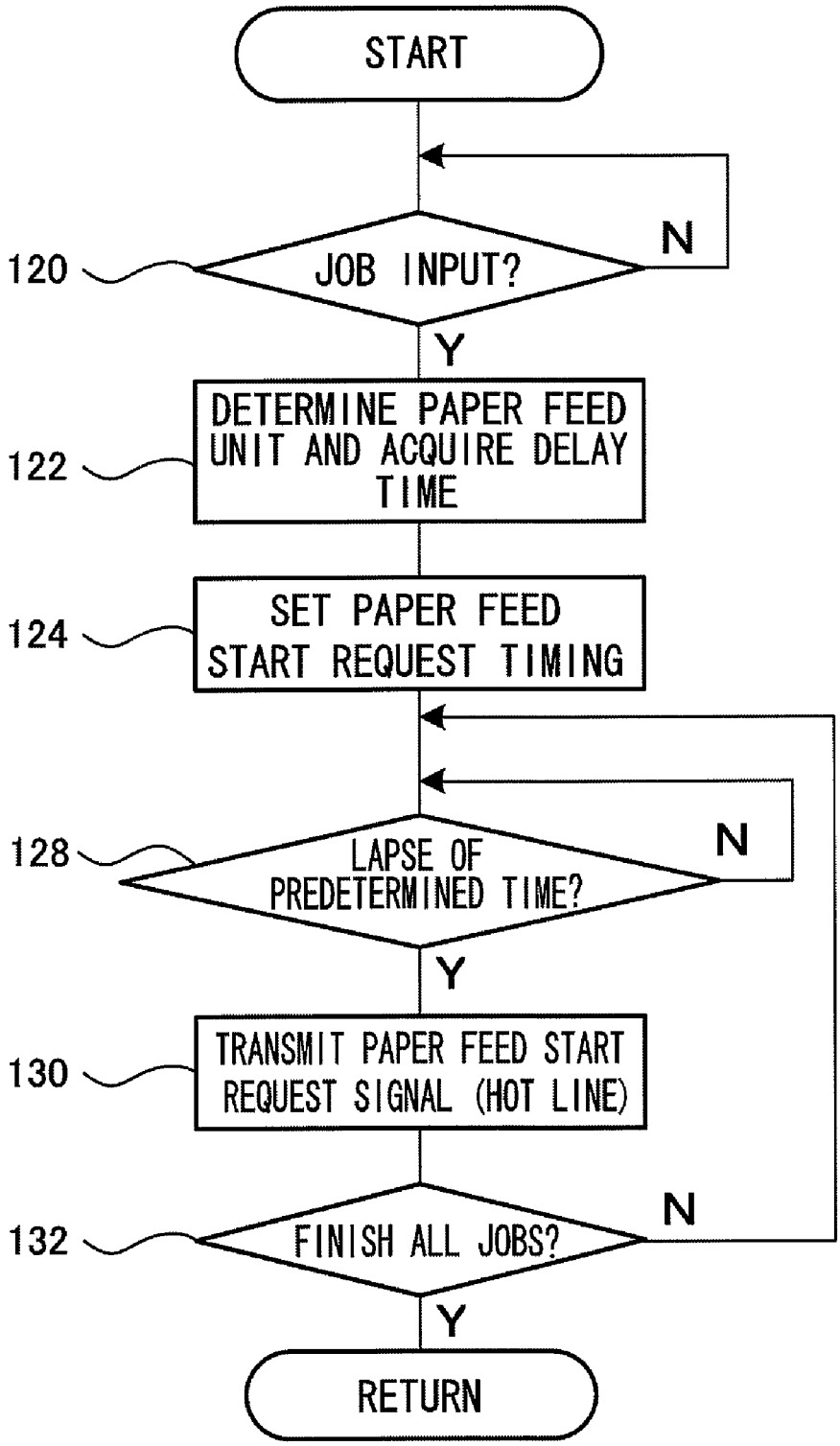
FIG. 8 is a flowchart illustrating a paper feed instruction routine by a main controller in the exemplary embodiment.

FIG. 8 is a flowchart illustrating a paper feed instruction routine by the main controller 90.

In step 120, the main controller 90 determines whether or not a job is input, and waits for an affirmative result.

In step 122, the main controller 90 decides a paper feeding apparatus 14 based on print information on the input job. Moreover, the main controller 90 acquires a delay time of a paper feed controller 94 of the paper feeding apparatus 14 from the memory 92. In the exemplary embodiment, the recording papers P of different sizes are accommodated in the paper feeding trays 70.

In step 124, the main controller 90 sets the paper feed start request timing. Specifically, the time (X ms) from the paper feed control reference timing to the paper feed start request timing has been predetermined, and thus, the acquired delay time is subtracted from the time (X−Y ms) (see FIGS. 5A and 5B).

In step 128, it is determined whether or not a time until the paper feed start request timing which has been set in step 124 elapses, and waits for an affirmative result.

In step 130, the main controller 90 transmits the paper feed start request signal to the paper feed controller 94. The main controller 90 transmits an ON signal over the hot line communication.

In step 132, it is determined whether or not all of jobs are finished. If the result is negative, the routine returns to step 128. To the contrary, if the result is affirmative, the routine ends.

In the exemplary embodiment, the delay time is acquired every time the job is input, it is not limited to this. The delay time may be acquired once when the configuration of the image forming system 10 is determined, and then, the acquired delay time of each of the paper feed controllers 94 may be stored in the memory 92. In this case, a delay time of a target paper feed controller 94 is read from the memory 92 and control the target paper feed controller 94 every time the job is input.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to are suited to the particular use contemplated. It is intended that the scope of the invention be defined by the following claims and their equivalents.

What is claimed is:

1. An image forming apparatus comprising:

an image forming apparatus body provided with an image formation unit which forms an image on a paper based on image information;

a plurality of paper feeding apparatuses, each of the plurality of paper feeding apparatuses accommodating the paper therein and feeding the paper to the image forming apparatus body, paper conveyance paths of the plurality of paper feeding apparatus being daisy-chained with respect to the image forming apparatus body;

an output unit that, using a signal transmission path, outputs an instruction signal which instructs a specified one of the paper feeding apparatuses to start feeding the paper when the image is formed by the image formation unit;

paper feed units disposed in the plurality of paper feeding apparatuses and that feed the paper upon receipt of the instruction signal from the output unit;

a recognition unit disposed in the image forming apparatus body and that recognizes a delay time of each of the plurality of paper feeding apparatuses the delay time being from after the instruction signal is received until it is determined by analysis that the instruction signal is a paper feed instruction; and a correction unit that corrects an output timing of the instruction signal from the output unit based on the delay time of each of the paper feeding apparatuses recognized by the recognition unit.

2. The image forming apparatus of claim 1, wherein the delay time is an analysis time in which noise generated in each of the plurality of paper feeding apparatuses is removed from the instruction signal, and the analysis time accumulates according to a number of paper feeding apparatuses that precede the specified paper feeding apparatus.

3. The image forming apparatus of claim 1, wherein before the instruction signal is output, the image formation unit outputs, to the specified paper feeding apparatus, a use signal which indicates an intention to use the specified paper feeding apparatus, and the recognition unit recognizes the respective delay times generated in each of the paper feeding apparatuses preceding the specified paper feeding apparatus by receiving a response signal with respect to the output use signal.

4. The image forming apparatus of claim 3, wherein the recognition unit receives, as the response signal, a total delay time which is obtained by accumulating the respective delay times of each of the plurality of paper feeding apparatuses from a paper feeding apparatus at a downstream side to a paper feeding apparatus at an upstream side, or individual delay times which are obtained by listing the delay time of each of the plurality of paper feeding apparatuses.

5. The image forming apparatus of claim 1, wherein the plurality of paper feeding apparatuses recognize that the instruction signal is the paper feed instruction when a predetermined number of the instruction signals is received within a predetermined interval, and recognize that the instruction signal is noise when the predetermined number of the instruction signals is not received at the predetermined interval.

6. The image forming apparatus of claim 1, wherein the correction unit corrects the output timing of the instruction signal by bringing forward the output timing by the amount of the delay time.

7. The image forming apparatus of claim 1, wherein the signal transmission path transmits a signal unidirectionally toward the specified paper feeding apparatus.

8. The image forming apparatus of claim 1, wherein the output unit is disposed in the image forming apparatus body.

9. The image forming apparatus of claim 1, wherein the correction unit is disposed in the image forming apparatus body.

10. A computer readable medium storing a program causing a computer to execute paper feed control processing in an image forming apparatus comprising: an image forming apparatus body provided with an image formation unit which forms an image on a paper based on image information; a plurality of paper feeding apparatuses, each of the plurality of paper feeding apparatuses accommodating the paper therein and feeding the paper to the image forming apparatus body, paper conveyance paths of the plurality of paper feeding apparatuses being daisy-chained with respect to the image forming apparatus body, the paper feed control processing comprising:

outputting an instruction signal using a signal transmission path which instructs a specified one of the paper feeding apparatuses to start feeding of the paper, when the image is formed by the image formation unit;

feeding the paper in the specified paper feeding apparatus upon receipt of the instruction signal;

recognizing a delay time of each of the plurality of paper feeding apparatuses, the delay time being from after the instruction signal is received until it is determined by analysis that the instruction signal is a paper feed instruction; and correcting an output timing of the instruction signal based on the recognized delay time of each of the paper feeding apparatuses.

11. The computer readable medium of claim 10, wherein the delay time is an analysis time in which noise generated in each of the plurality of paper feeding apparatuses is removed from the instruction signal, the analysis time being accumulated in according to a number of paper feeding apparatuses that precede the specified paper feeding apparatus.

12. The computer readable medium of claim 10, wherein the paper feed control processing further comprises, before the instruction signal is output, outputting, to the specified paper feeding apparatus, a use signal which indicates an intention to use the specified paper feeding apparatus, and the recognizing includes recognizing the respective delay times generated of each of the paper feeding apparatuses preceding the specified paper feeding apparatus by receiving a response signal with respect to the output use signal.

13. The computer readable medium of claim 10, wherein the response signal includes a total delay time which is obtained by accumulating the respective delay times of each of the plurality of paper feeding apparatuses from a paper feeding apparatus at a downstream side to a paper feeding apparatus at an upstream side, or individual delay times which are obtained by listing the delay time of each of the plurality of paper feeding apparatuses.

14. A paper feed control method in an image forming apparatus that comprises an image forming apparatus body provided with an image formation unit which forms an image on a paper based on image information; a plurality of paper feeding apparatuses, each of the plurality of paper feeding apparatuses accommodating the paper therein and feeding the paper to the image forming apparatus body, paper conveyance paths of the plurality of paper feeding apparatuses being daisy-chained with respect to the image forming apparatus body, the method comprising:

outputting an instruction signal, using a signal transmission path, which instructs a specified one of the paper feeding apparatuses to start feeding the paper, when the image is formed by the image formation unit;

feeding the paper in the specified paper feeding apparatus upon receipt of the instruction signal;

recognizing a delay time of each of the plurality of paper feeding apparatuses, the delay time being from after the instruction signal is received until it is determined by analysis that the instruction signal is a paper feed instruction; and correcting an output timing of the instruction signal based on the recognized delay time of each of the paper feeding apparatuses.

15. An image forming system comprising:

an image formation unit that forms an image on a paper based on image information;

a plurality of paper feeding apparatuses, each of the plurality of paper feeding apparatuses accommodating the paper therein and feeding the paper to the image formation unit, paper conveyance paths of the plurality of paper feeding apparatuses being a daisy-chained;

an output unit that, using a signal transmission path, outputs an instruction signal which instructs a specified one of the paper feeding apparatuses to start feeding the paper, when the image is formed by the image formation unit;

a paper feed unit that executes feeding of the paper upon receipt of the instruction signal from the output unit;

a recognition unit that recognizes a delay time of each of the plurality of paper feeding apparatuses, the delay time being from after the instruction signal is received until it is determined by analysis that the instruction signal is a paper feed instruction; and a correction unit that corrects an output timing of the instruction signal from the output unit based on the delay time of each of the paper feeding apparatuses recognized by the recognition unit.

* * * * *